US009004324B2

(12) United States Patent
Adams et al.

(10) Patent No.: US 9,004,324 B2
(45) Date of Patent: Apr. 14, 2015

(54) DUAL ACTIVATED ACTUATOR CAP

(71) Applicant: S.C. Johnson & Son, Inc., Racine, WI (US)

(72) Inventors: Mary Beth Adams, Antioch, IL (US); Jeffrey J. Christianson, Oak Creek, WI (US); Daniel A. Andersen, Burlington, WI (US); Han Xin, Austin, TX (US); Matthew Grossman, Austin, TX (US); Kit R. Morris, Austin, TX (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/859,431

(22) Filed: Apr. 9, 2013

(65) Prior Publication Data

US 2013/0228593 A1 Sep. 5, 2013

Related U.S. Application Data

(63) Continuation of application No. 12/732,895, filed on Mar. 26, 2010, now Pat. No. 8,444,026.

(51) Int. Cl.

| | |
|---|---|
| ***B65D 83/00*** | (2006.01) |
| ***B65D 83/20*** | (2006.01) |
| *B67B 1/00* | (2006.01) |

(52) U.S. Cl.

CPC ..... *B65D 83/206* (2013.01); *Y10T 29/49826* (2013.01); *B65D 83/205* (2013.01)

(58) Field of Classification Search

USPC ..... 222/402.13, 402.15, 321.8, 153.11, 222/182, 402.1

See application file for complete search history.

(56) References Cited

U.S. PATENT DOCUMENTS

| | | | |
|---|---|---|---|
| 3,478,935 | A | 11/1969 | Brooks |
| 3,664,557 | A | 5/1972 | Bruce |
| 3,781,942 | A | 1/1974 | Coleman |
| 3,977,576 | A | 8/1976 | Amabili |
| 3,987,941 | A | 10/1976 | Blessing |
| 4,033,487 | A | 7/1977 | Micallef |
| 4,077,548 | A | 3/1978 | Beard |
| 4,077,549 | A | 3/1978 | Beard |
| 4,142,653 | A | 3/1979 | Mascia et al. |
| 4,235,353 | A | 11/1980 | Capra et al. |
| 4,506,808 | A | 3/1985 | Goncalves |
| 5,018,647 | A | 5/1991 | Abplanalf |
| D406,763 | S | 3/1999 | Watkins et al. |
| D413,514 | S | 9/1999 | Pericard et al. |

(Continued)

FOREIGN PATENT DOCUMENTS

| | | | |
|---|---|---|---|
| ES | 2141689 | A1 | 3/2000 |
| WO | 2007149459 | A2 | 12/2007 |
| WO | 2010056724 | A1 | 5/2010 |

OTHER PUBLICATIONS

PCT/US2011/000546 Written Opinion and International Search Report dated Jun. 27, 2011.

*Primary Examiner* — Kevin P Shaver
*Assistant Examiner* — Nicholas J Weiss

(57) ABSTRACT

An actuator cap includes a housing and an actuator. The actuator has first and second actuating members and a manifold in fluid communication with a dispensing orifice. The actuator is hingedly attached to the housing at a pivot. The pivot is located on an interior surface of the housing and positioned at or above a base of the manifold. The actuator resiliently deforms about the pivot when one of the first and second actuating members is actuated.

7 Claims, 11 Drawing Sheets

(56) References Cited

U.S. PATENT DOCUMENTS

| | | | |
|---|---|---|---|
| 5,992,707 | A | 11/1999 | Gaichuk |
| 6,283,333 | B1 | 9/2001 | Knickerbocker et al. |
| 6,302,302 | B1 | 10/2001 | Albisetti |
| D478,285 | S | 8/2003 | Pannozzo et al. |
| 6,832,700 | B2 | 12/2004 | Roberts et al. |
| D507,487 | S | 7/2005 | Marroncles |
| D508,851 | S | 8/2005 | Nelson et al. |
| 7,104,427 | B2 | 9/2006 | Pericard et al. |
| D532,301 | S | 11/2006 | Moretti |
| D532,302 | S | 11/2006 | Moretti |
| 7,159,736 | B1 | 1/2007 | Torelli |
| D536,969 | S | 2/2007 | Geier |
| D537,715 | S | 3/2007 | Downey et al. |
| D543,106 | S | 5/2007 | Foster et al. |
| 7,249,692 | B2 | 7/2007 | Walters et al. |
| 7,255,244 | B2 | 8/2007 | Miller |
| D561,024 | S | 2/2008 | Altonen et al. |
| D567,651 | S | 4/2008 | Bloc |
| D575,153 | S | 8/2008 | Caroen et al. |
| D576,490 | S | 9/2008 | Mazurkiewicz et al. |
| D580,265 | S | 11/2008 | Turchi |
| 7,487,891 | B2 | 2/2009 | Yerby et al. |
| 7,494,025 | B2 | 2/2009 | Porter |
| D587,576 | S | 3/2009 | Miller et al. |
| D596,939 | S | 7/2009 | Moretti |
| 7,784,650 | B2 | 8/2010 | Bates et al. |
| 7,850,046 | B2 | 12/2010 | Carta |
| 2004/0222246 | A1 | 11/2004 | Bates et al. |
| 2007/0062980 | A1 | 3/2007 | Bates et al. |
| 2007/0290002 | A1 | 12/2007 | Schmitz et al. |
| 2008/0164285 | A1 | 7/2008 | Hygema |
| 2008/0210710 | A1 | 9/2008 | Marquardt et al. |
| 2009/0014679 | A1 | 1/2009 | Hygema et al. |
| 2009/0283609 | A1 | 11/2009 | Strand |
| 2010/0004401 | A1 | 1/2010 | Ito et al. |
| 2013/0277397 | A1 | 10/2013 | Erickson et al. |

DUAL ACTIVATED ACTUATOR CAP

CROSS REFERENCE TO RELATED APPLICATIONS

The present application is a continuation application of U.S. patent application Ser. No. 12/732,895 filed Mar. 26, 2010.

REFERENCE REGARDING FEDERALLY SPONSORED RESEARCH OR DEVELOPMENT

Not Applicable

SEQUENTIAL LISTING

Not Applicable

BACKGROUND OF THE INVENTION

1. Field of the Invention

The present invention generally relates to a device for dispensing product from a container. More particularly, the present invention relates to a dual activated actuator cap for engaging and actuating a valve assembly of a pressurized container.

2. Description of Related Art

Pressurized containers are commonly used to store and dispense volatile materials, such as air fresheners, deodorants, insecticides, germicides, decongestants, perfumes, and the like. The volatile materials are typically stored in a pressurized and liquefied state within the container. A release valve with an outwardly extending valve stem may be provided to facilitate the release of the volatile material, whereby activation of the valve via the valve stem causes volatile material to flow from the container through the valve stem and into the outside atmosphere. The release valve may typically be activated by tilting, depressing, or otherwise displacing the valve stem.

Actuators, dispensers, overcaps, etc., may sometimes be used to assist in dispensing pressurized fluid from a container. Such discharge devices may include a mechanism for engaging the valve stem of the container. Some actuator mechanisms may include linkages that apply downward pressure to depress the valve stem and open the valve within the container. Other actuating mechanisms may instead apply radial pressure where the container has a tilt-activated valve stem. In any case, these actuating mechanisms provide a relatively convenient and easy to use interface for end users.

Conventional actuating mechanisms include either an actuating button or an actuating trigger. Traditional actuating buttons have a discharge orifice situated within the button that defines a duct through which liquid product may pass. The duct is typically defined to lead and engage the valve stem of an associated container. Thus, when dispensement is desired, a user may depress the actuator button, which in turn depresses or tilts the valve stem and opens the valve within the associated container, thereby releasing the contents of the container through the discharge duct and out of the discharge orifice.

Alternatively, an actuating trigger may be used to dispense liquid product from an associated container. Actuating trigger mechanisms typically include a moveable trigger attached to a pivot or hinge point on the actuator body. The actuator body may include a discharge orifice that defines a duct through which liquid product may pass. The duct may typically be defined to lead to and engage the valve stem of the associated container. The trigger may be biased by engagement with the valve stem or an additional spring return such that the trigger remains in a neutral unactuating position when no product is desired to be dispensed. When product dispensement is desired, a user may grasp the actuator and pull the trigger with enough force to overcome any bias. Actuation of the trigger mechanism may thereby actuate an associated nozzle piece or valve stem on the container, thereby releasing pressurized product to the outside atmosphere through the dispensing duct.

A distinct segment of consumers prefer to use actuating triggers, while others favor traditional actuating buttons. Each has its pros and cons. Buttons are a tried and true approach, but the relatively awkward gripping and finger placement may be uncomfortable for some. While trigger mechanisms have evolved as a viable alternative, such triggers may be difficult to mold or manufacture because of the numerous parts necessary for adequate functionality. Additionally, there may be switching costs that limit the viability of actuating triggers as an alternative for users who have grown accustomed to actuating buttons.

BRIEF SUMMARY OF THE INVENTION

According to one embodiment of the present invention, an actuator cap includes a housing and an actuator. The actuator has first and second actuating members and a manifold in fluid communication with a dispensing orifice. The actuator is hingedly attached to the housing at a pivot. The pivot is located on an interior surface of the housing and positioned at or above a base of the manifold. The actuator resiliently deforms about the pivot when one of the first and second actuating members is actuated.

According to another embodiment of the present invention, an actuator cap has a housing configured to be attached to a container having a valve stem. A dispensing orifice is in fluid communication with a manifold. The manifold includes a base adapted to place same in fluid communication with a valve stem of a container. An actuator includes first and second actuating members extending from an end defined by the dispensing orifice. The first actuating member includes a distal end and the second actuating member includes a lower end. The actuator is hingedly attached to the housing at a pivot. The pivot is located within a region bounded by the ends of the first and second actuating members. The actuator resiliently deforms about the pivot when one of the first and second actuating members is actuated.

According to still another embodiment of the present invention, a method of manufacturing an actuator cap for a container includes the step of providing a housing. The method further includes the step of attaching an actuator to the housing. The actuator includes first and second actuating members and a dispensing orifice in fluid communication with a manifold. The manifold includes a base adapted to place same in fluid communication with a valve stem of a container. A pivot is located at or above the base of the manifold. The actuator is adapted to pivot about the housing and resiliently deform when one of the first and second actuating members is actuated.

DETAILED DESCRIPTION OF THE INVENTION

Figure 1:
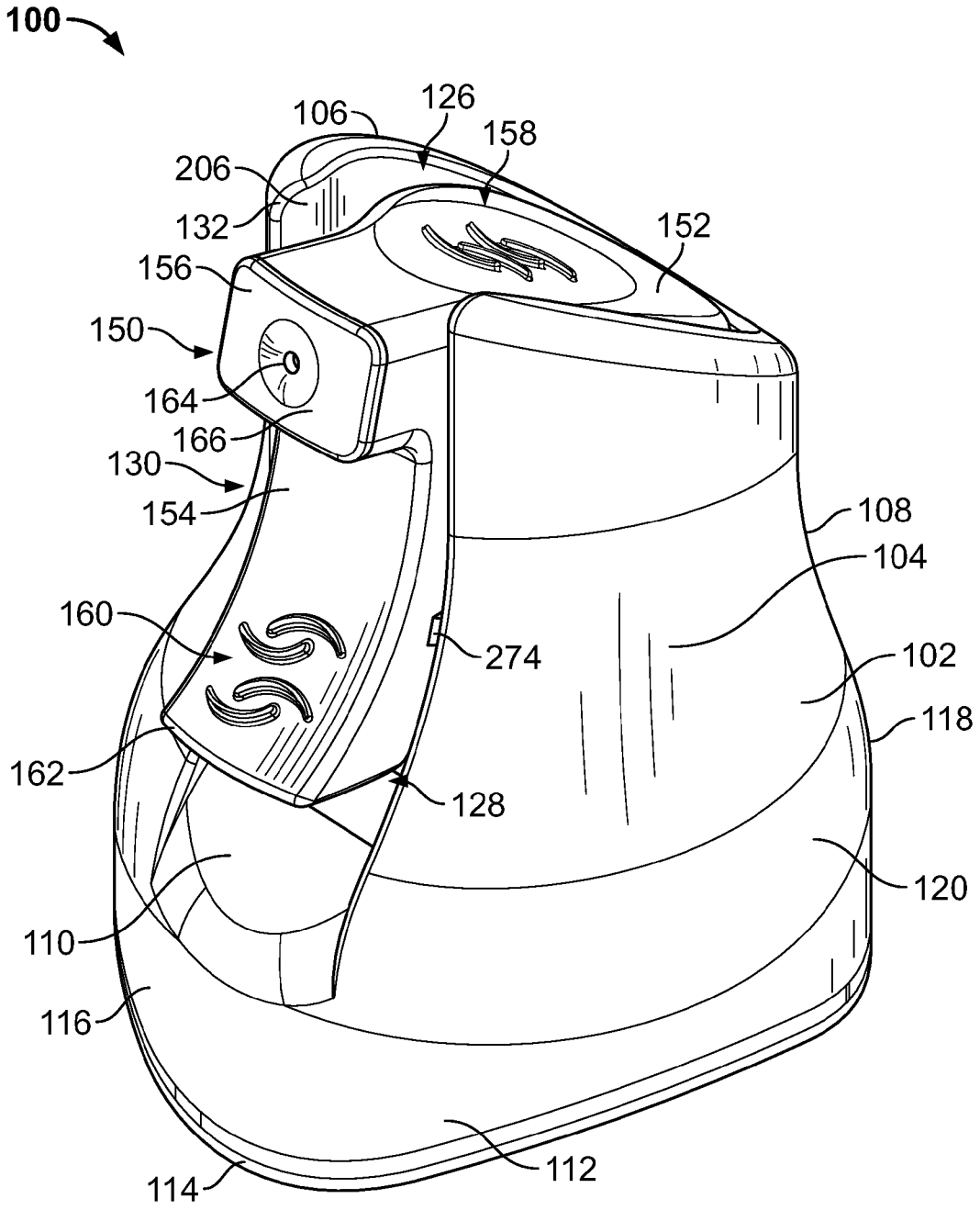
FIG. 1 illustrates an isometric view of a top, left, and front side of a dual activated actuator cap according to an embodiment of the present invention.

As illustrated in FIGS. 1-6, a dual activated actuator cap 100 is presented, which includes a housing 102. The housing 102 includes a sidewall 104 having a top portion 106, a neck portion 108, a lip portion 110, and a lower skirt portion 112. The sidewall 104 has a generally bell-shaped appearance.

With reference to FIGS. 2-5, the lower skirt portion 112 of the sidewall 104 is cylindrical. A bottom edge 114 of the lower skirt portion 112 is imparted with a curve so that the bottom edge 114 of the portion 112 appears concave when viewed from front and rear sides 116, 118 and convex when viewed from left and right sides 120, 122, respectively. The sidewall 104 tapers upwardly and inwardly from the lower skirt portion 112 in a convex manner toward an inflection point 124, whereupon the sidewall 104 is imparted with a concave appearance. When viewed from the front and rear sides 116, 118, the sidewall 104 adjacent the neck portion 108 appears to taper upwardly in a uniformly cylindrical manner. The top portion 106 is disposed adjacent the neck portion 108 and has a generally convex appearance. Alternatively, the sidewall 104 of the housing 102 may be formed to appear rectangular, triangular, spherical, conical, or any other geometric shape.

Figure 4:
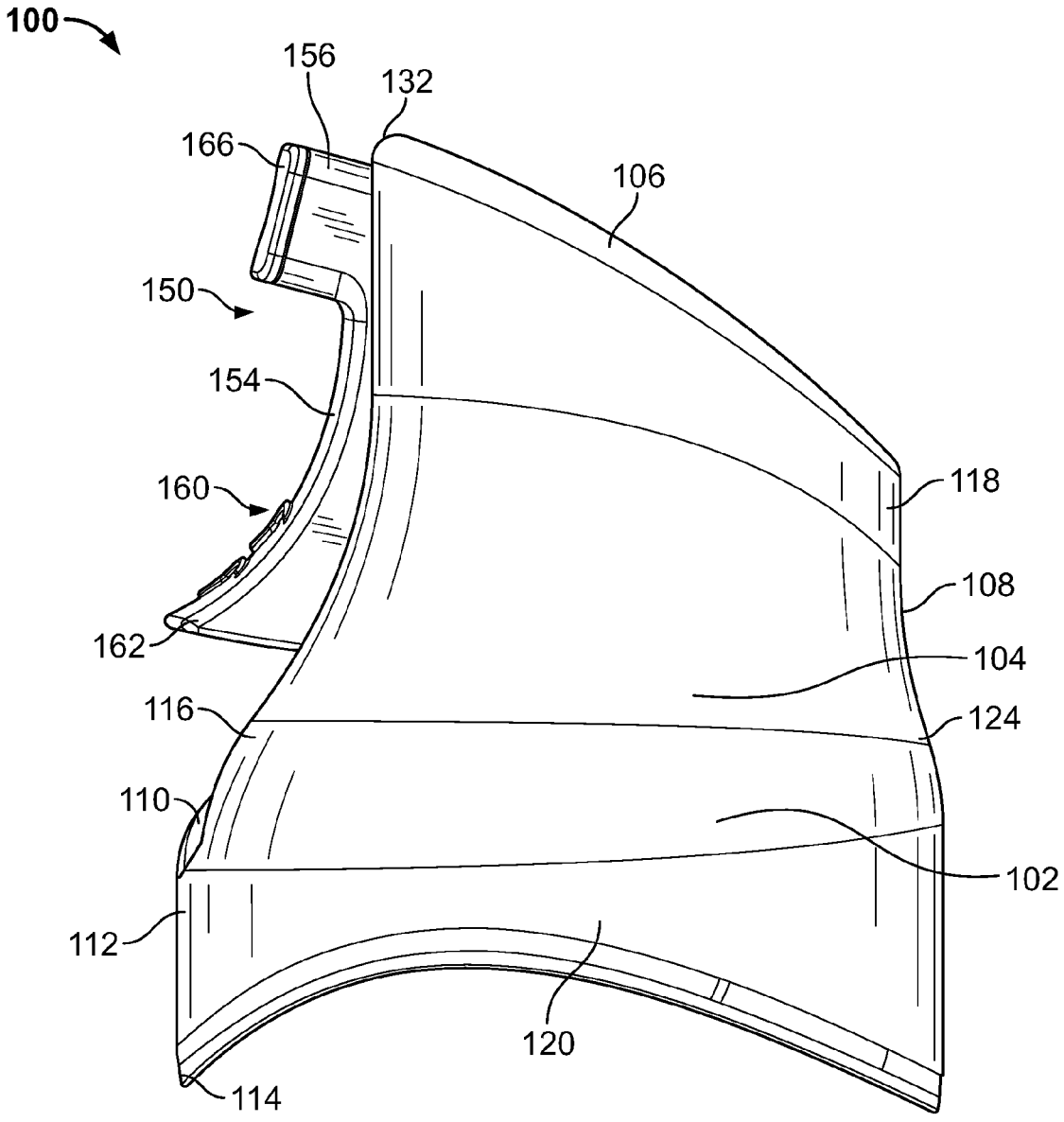
FIG. 4 illustrates a left side elevational view of the dual activated actuator cap of FIG. 1.
Figure 5:
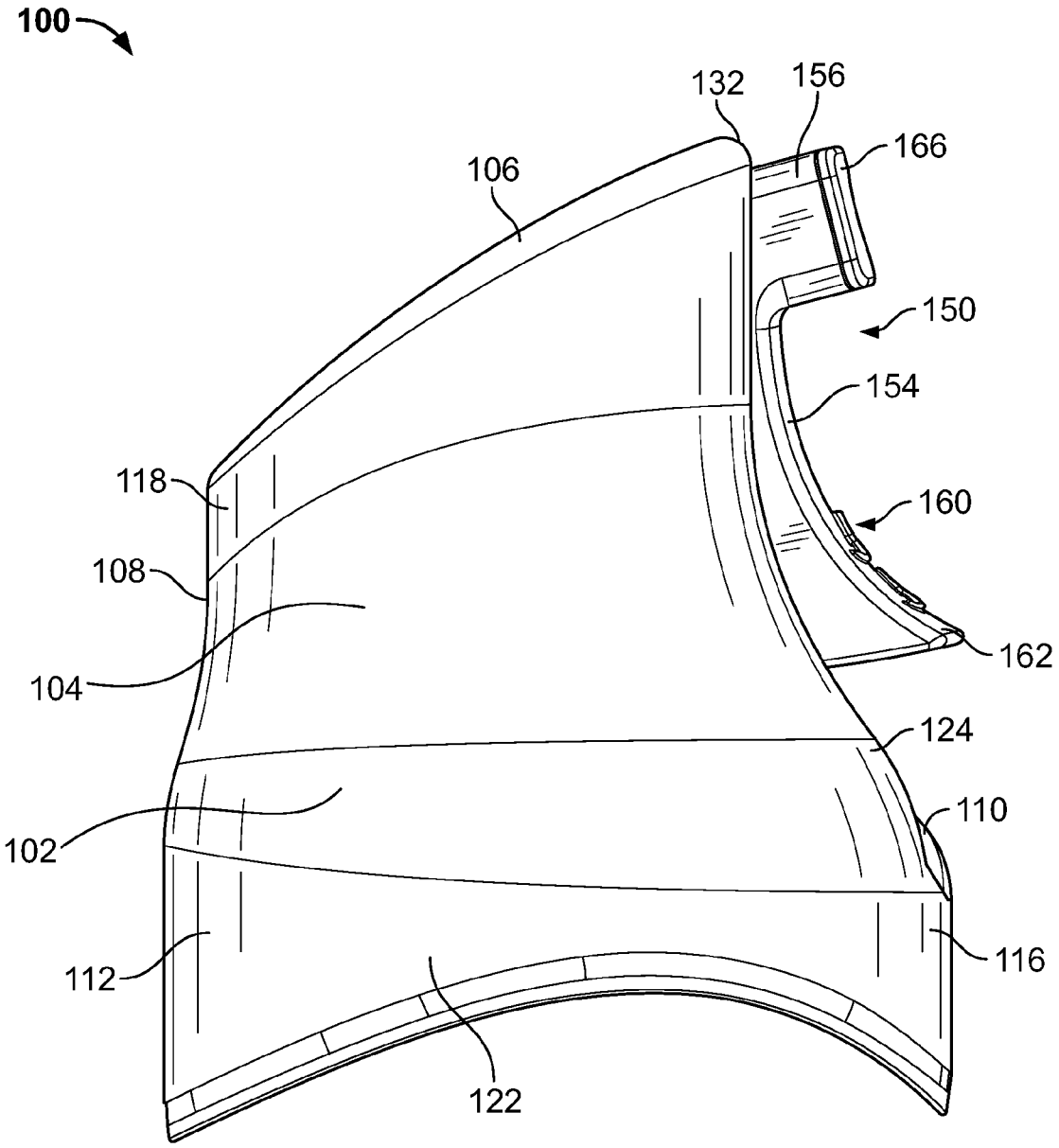
FIG. 5 illustrates a right side elevational view of the dual activated actuator cap of FIG. 1.
Figure 6:
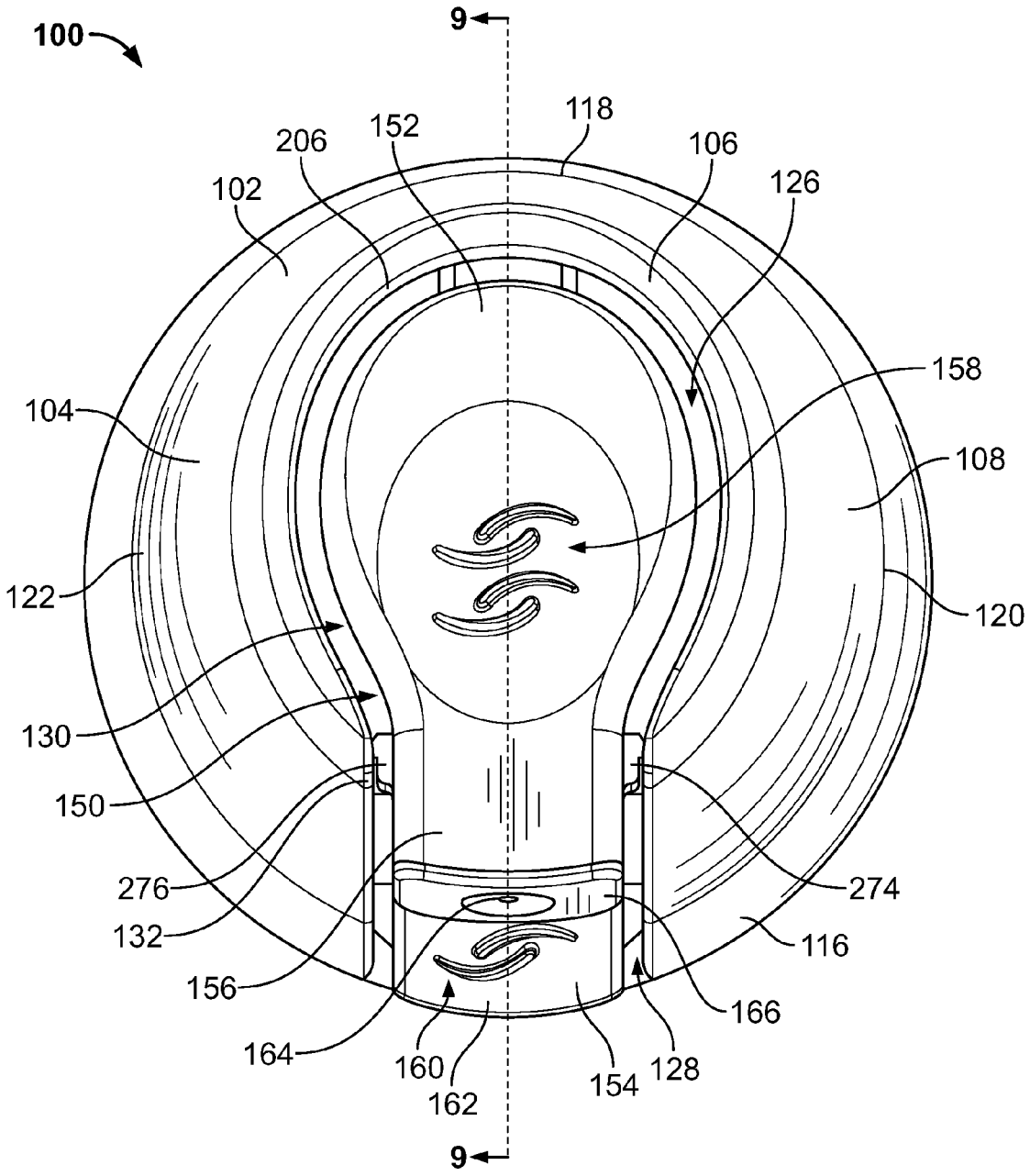
FIG. 6 illustrates a top plan view of the dual activated actuator cap of FIG. 1.

With reference to FIGS. 4 and 5, the top portion 106 is depicted as being angled between the front and rear sides 116, 118 of the housing 102. Specifically, the top portion 106 adjacent the rear side 118 is lower than the top portion 106 adjacent the front side 116. Turning to FIG. 6, the top portion 106 and portions of the sidewall 104 extending above the lower skirt portion 112 have a generally oval shape. A similarly shaped oval opening 126 is provided within the top portion 106. The sidewall 104 and portions of the top portion 106 are also truncated by a rectangular opening 128 adjacent the front side 116. The oval opening 126 and the rectangular opening 128 are integral with on another to define an opening 130, which is adapted to receive an actuator that will be described in more detail below. However, it is anticipated that the opening 130 may be fashioned in any manner to appropriately receive an actuator.

Figure 2:
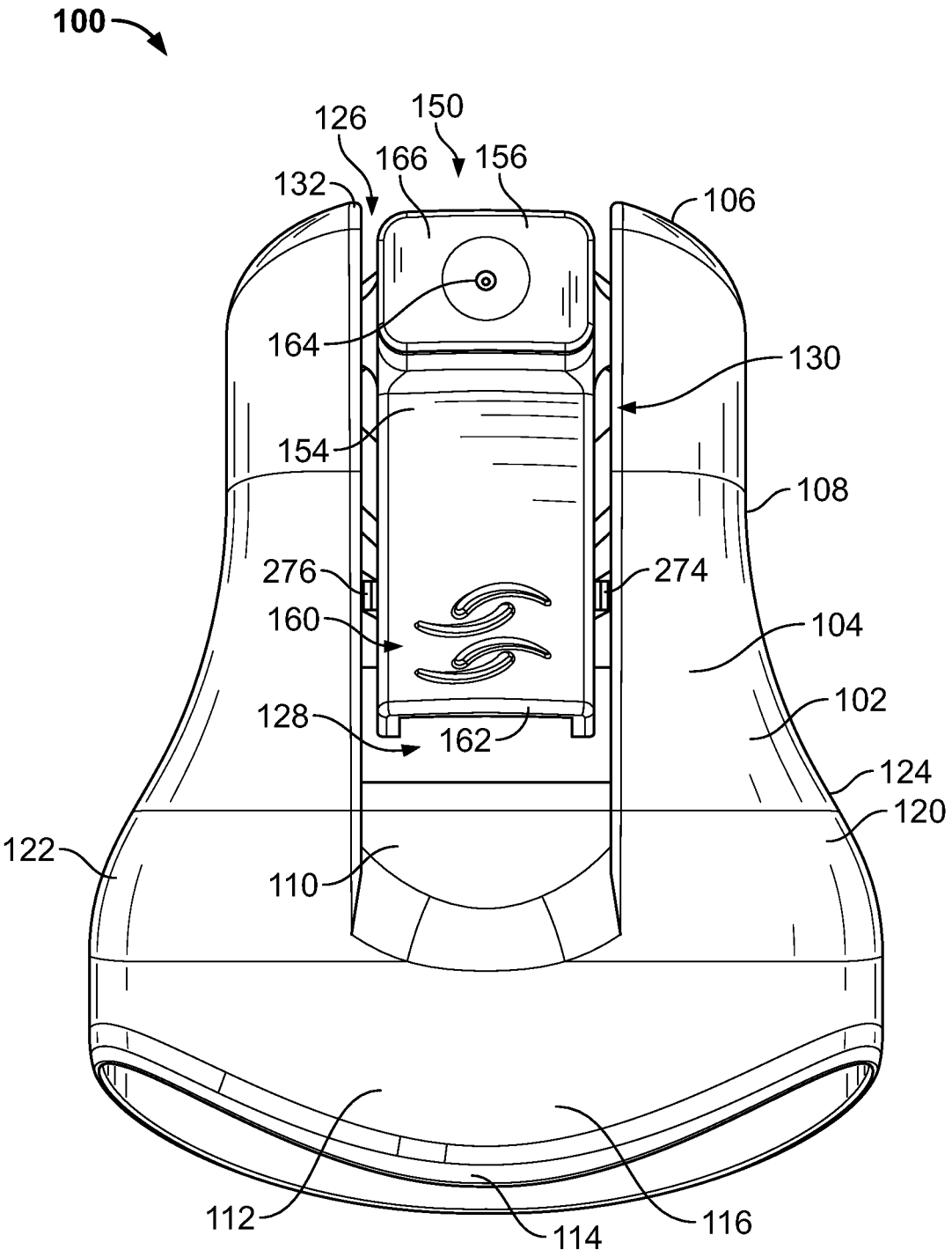
FIG. 2 illustrates a front elevational view of the dual activated actuator cap of FIG. 1.
Figure 9:
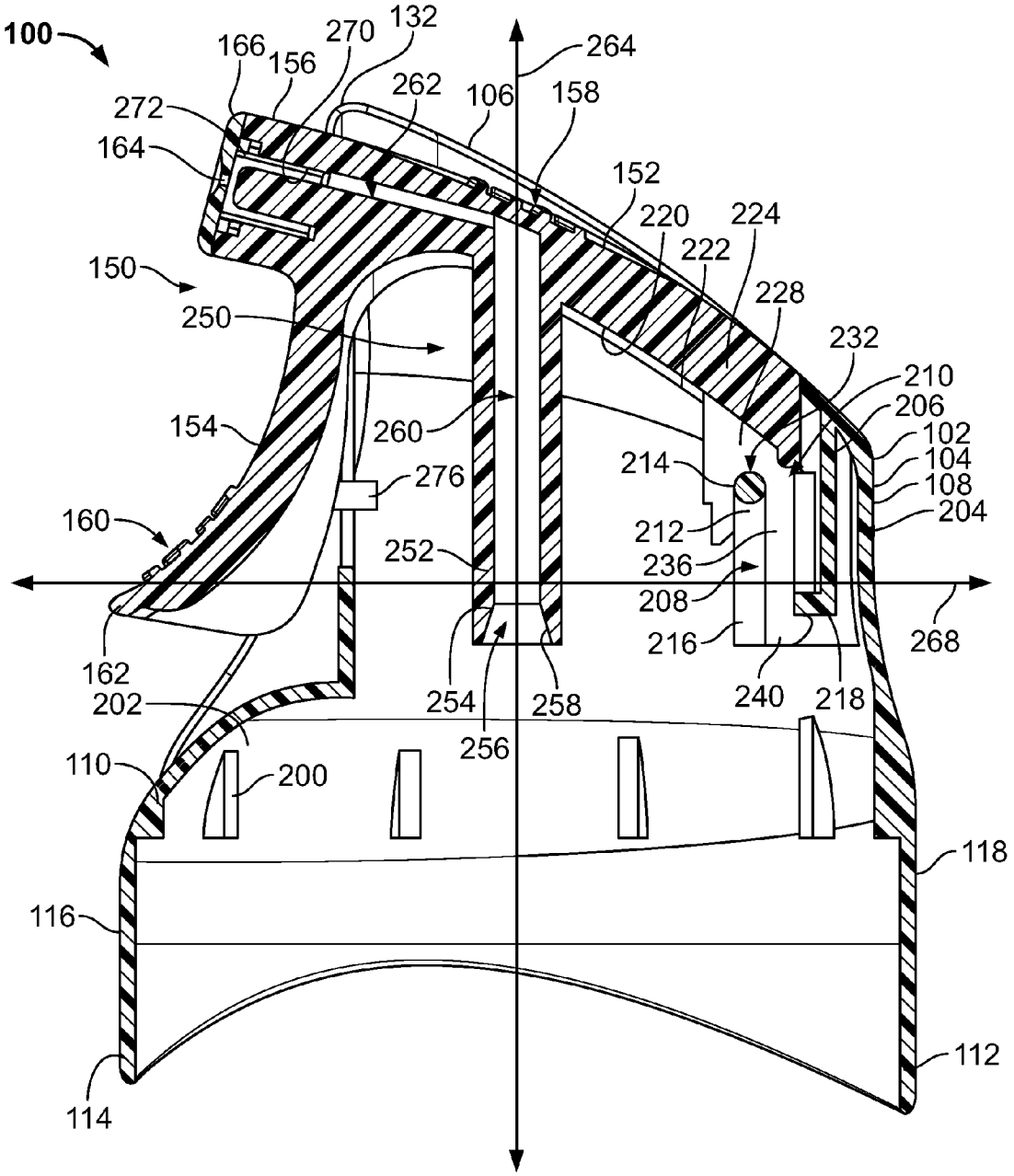
FIG. 9 illustrates a cross-sectional view of the dual activated actuator cap of FIG. 1 about the line 9-9 of FIG. 6.

As seen in FIGS. 1 and 2, the lip portion 110 is located in the front side 116 of the housing 102 adjacent the lower skirt portion 112. The lip portion 110 gradually tapers upwardly and inwardly from an exterior of the housing 102 toward an interior of the housing 102. The lip portion 110 may recede at a constant rate, such as on a linear incline, or at an exponential or logarithmic rate, as typical of a curved incline. As shown in FIG. 9, the lip portion 110 extends inwardly to a point where it is in substantial vertical alignment with a front lateral edge 132 of the top portion 106 of the housing 102.

The top portion 106, the neck portion 108, the lip portion 110, and the lower skirt portion 112 of the housing 102 may be integrally formed and seamlessly connected so as to appear unitary. Alternatively, the top portion 106, the neck portion 108, the lip portion 110 and the lower skirt portion 112 of the housing 102 may consist of one or more separate pieces connected by welding, adhesive, snap and fit connections, screws, rivets, hooks or any other means of connection known to those of ordinary skill in the art.

Turning to FIG. 1, the dual activated actuator cap 100 further includes an actuator 150. The actuator 150 includes a first actuating member 152, a second actuating member 154, and a nozzle 156. In one embodiment of the present invention, the first actuating member 152 is a push button and the second actuating member 154 is a trigger. The first and second actuating members 152, 154 include first and second gripping portions 158, 160, respectively. The gripping portions 158, 160 comprise upraised curved ridges to assists users in remaining in tactile contact with the actuator 150. In other embodiments, the gripping portions 158, 160 may include fewer or greater numbers of ridges or may be imparted with a different geometric shape. Further, other types of gripping portions, such as indentations or grooves, material exhibiting greater frictional properties, upraised logos, or any other means for increasing the gripability of an actuator as known to one of skill in the art, may be utilized in lieu of or in conjunction with the gripping portions 158, 160.

Figure 3:
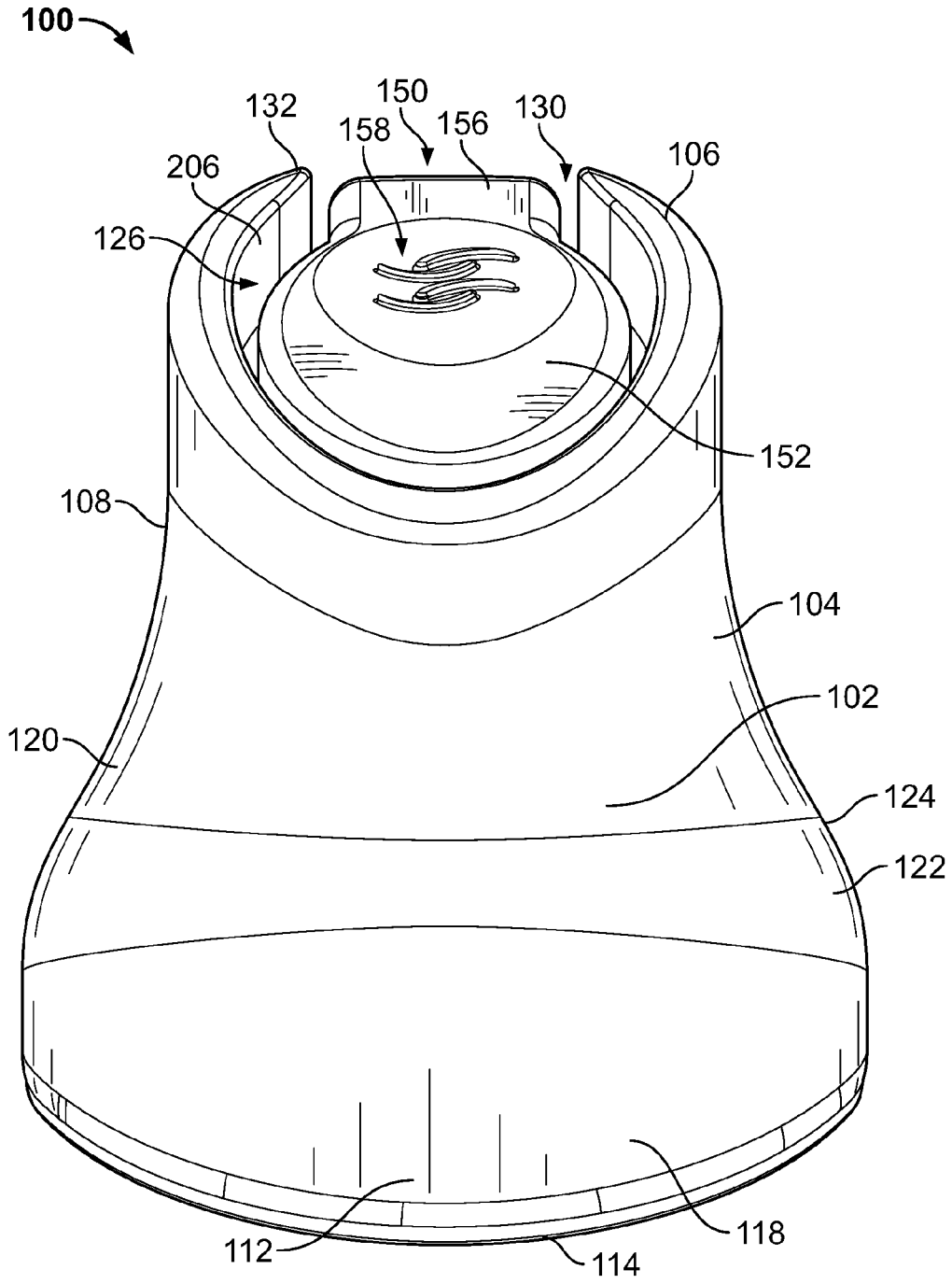
FIG. 3 illustrates a rear elevational view of the dual activated actuator cap of FIG. 1.

As shown in FIGS. 1, 3, and 6, the first actuating member 152 is disposed within the oval opening 126 provided in the top portion 106 of the housing 102. The first actuating member 152 has a complementary oval shape. The first gripping portion 158 of the present embodiment is disposed on the first actuating member 152 and includes a plurality of ridges provided in a concave depression to assist a user in gripping the actuator 150 and/or in orienting a user's finger(s). Turning to FIG. 2, the second actuating member 154 is shown within the rectangular opening 128 in the front side 116 of the housing 102. The second actuating member 154 has a complementary shape to the rectangular opening 128. FIG. 1 depicts the second actuating member 154 being connected to the first actuating member 152 by the nozzle 156. The second actuating member 154 extends downwardly from the nozzle 156 to a point adjacent the lip portion 110 of the housing 102. A lower end 162 of the second actuating member 154 curves outwardly from the nozzle 156 and the front side 116 of the housing 102. The curved lower end 162 assists in providing an improved gripping surface for one or more fingers of a user. The second gripping portion 160 is disposed on the curved lower end 162. It is also contemplated that the first and second actuating members 152, 154 and the oval and rectangular openings 126, 128, respectively, may be imparted with different complementary geometric shapes.

With reference to FIG. 1, the nozzle 156 is disposed forward of the first actuating member 152 and above the second actuating member 154. The nozzle 156 is integrally attached to both the first and second actuating members 152, 154. However, in other embodiments one or more of the nozzle 156, the first actuating member 152, and the second actuating member 154 may comprise discrete pieces that are attached to one another by an adhesive, welding, a snap and fit connection, or any other means known to one of ordinary skill in the art. FIGS. 1, 2, 4, and 5 depict the nozzle 156 as a generally rectangular extension of the actuator 150 with rounded corners. The nozzle 156 extends outwardly beyond the top portion 106 and the neck portion 108 adjacent the front side 116, but does not extend past the lip portion 110. A dispensing orifice 164 is disposed within a circular depression within a front wall 166 of the nozzle 156. The dispensing orifice 164 of the present embodiment is circular. It is contemplated that the rectangular nozzle 156 and the circular dispensing orifice 164 may be imparted with other geometric shapes.

Figure 7:
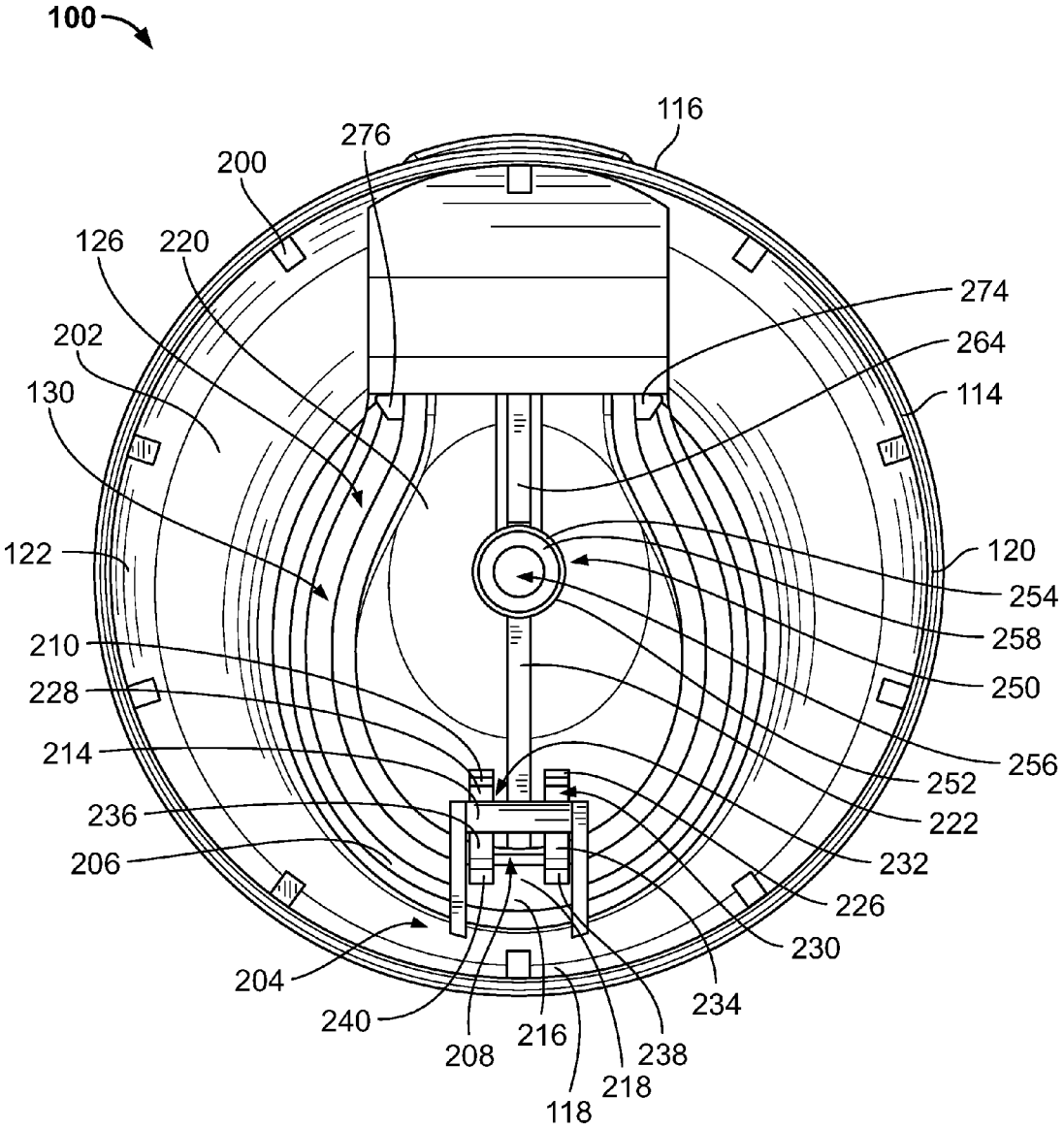
FIG. 7 illustrates a bottom elevational view of the dual activated actuator cap of FIG. 1.
Figure 8:
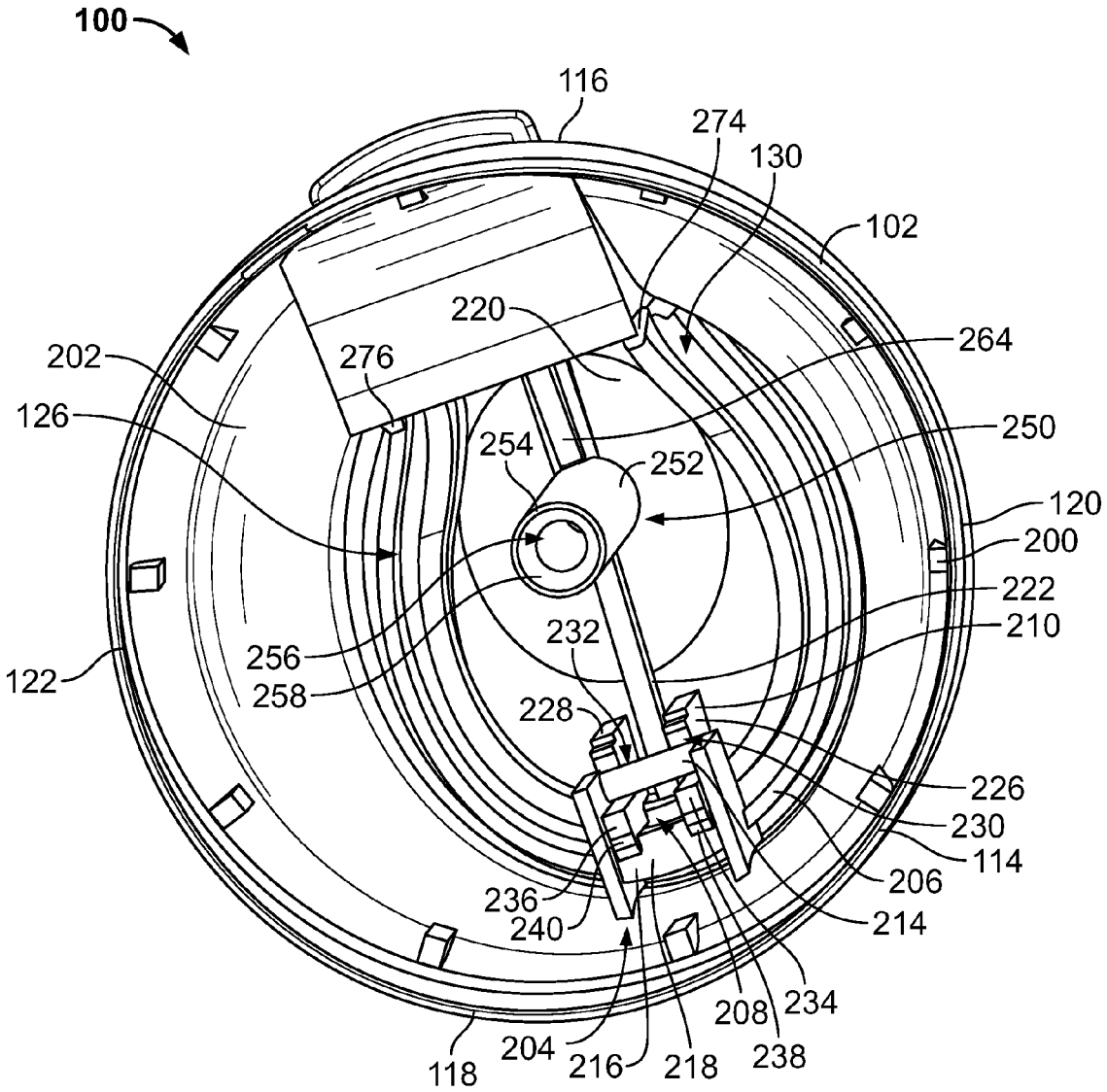
FIG. 8 illustrates a bottom isometric view of the dual activated actuator cap of FIG. 1.

Turning to FIGS. 7-9, a plurality of flanges 200 are depicted extending from an inner wall 202 of the housing 102. The flanges 200 are preferably integrally formed with the housing 102 and attached to the inner wall 202 adjacent the lower skirt portion 112. When the actuator cap 100 is connected to a container (see, e.g., FIGS. 10 and 11), the lower skirt portion 112 extends over and around an upper end of the container. Further, the flanges 200 snap-fit with portions of the container to hold the actuator cap 100 thereon, e.g., in one embodiment the flanges 200 are secured within an undercut of a mounting cup on a container. In other embodiments, the lower skirt portion 112 may extend over the upper end of the container to a greater or lesser extent. Indeed, it is contemplated that the lower skirt portion 112, flanges 200, or other housing 102 portions may be modified so that the lower skirt portion 112 sits atop the container.

With reference to FIGS. 8 and 9, a mounting assembly 204 is provided within the housing 102 on the rear side 118. The mounting assembly 204 extends from the inner wall 202 adjacent the neck portion 108 and from a depending lip 206 of the top portion 106. The mounting assembly 204 is generally rectangular and includes an aperture 208 for receipt of a hinging element 210. An upper end 212 of the mounting assembly 204 includes a pivot bar 214, which has a generally cylindrical shape. A lower end 216 of the mounting assembly 204 has an undercut portion 218.

An inner surface 220 of the actuator 150 includes a resilient member 222, which is centrally disposed about a width of the actuator. The resilient member 222 extends about the inner surface 220 from the lower end 162 of the second actuating member 154 to a distal end 224 of the first actuating member 152. The resilient member 222 provides additional structural rigidity to the actuator 150 when vertical and transverse forces are acted thereupon. The hinging element 210 depends from the resilient member 222 adjacent the distal end 224 thereof.

With reference to FIGS. 7-9, the hinging element 210 includes first and second arms 226, 228 spaced from one another. The first and second arms 226, 228 include grooves 230, 232, respectively. Latching members 234, 236 extend downwardly from the hinging element 210 adjacent the inner wall 202. The latching members 234, 236 include first and second gripping members 238, 240, respectively. With particular reference to FIG. 9, the actuator 150 is secured to the housing 102 by inserting the latching members 234, 236 through the aperture 208 of the mounting assembly 204. When secured, portions of the hinging element 210 defining the grooves 230, 232 are disposed adjacent the pivot bar 214 and the gripping members 238, 240 are engaged with the undercut portion 218. In one embodiment, portions of the hinging element 210 adjacent the grooves 230, 232 are bent by mechanical means to capture the pivot bar 214 within the grooves 230, 232, e.g., a cold or hot mechanical bending operation may be undertaken.

The actuator 150 further includes a manifold 250 integrally connected thereto. The manifold 250 comprises a first product passageway 252 having a base 254. The first product passageway 252 extends upwardly toward the inner surface 220 of the actuator 150 and interrupts a portion of the resilient member 222. FIG. 8 depicts the base 254 being substantially cylindrical with a cylindrical orifice 256 disposed therein. The cylindrical orifice 256 is defined by a frustoconical wall 258, which is adapted to receive and sealingly engage with a valve stem (see FIGS. 10 and 11) of a conventional aerosol container. A first channel 260 extends through the first product passageway 252 from the cylindrical orifice 256 toward a second channel 262 within a second product passageway 264 (see FIG. 9). The first product passageway 252 is substantially parallel with a longitudinal axis 264 of the housing 102, whereas the second channel 262 is angled with respect to a transverse axis 268 of the housing 102. In the present embodiment, the second channel 262 is angled about 5 degrees from the transverse axis 268.

The second channel 262 of the second product passageway 252 extends into a swirl chamber 270 of the nozzle 156. The swirl chamber 270 is adapted to receive an insert 272 for imparting turbulence and/or a desired spray pattern to fluid being discharged from the dispensing orifice 164 of the nozzle 156. The swirl chamber 270 and the dispensing orifice 164 are similarly angled with respect to the second channel 262. However, it is contemplated that one or more of the second channel 262, the swirl chamber 270, and the dispensing orifice 164 may be angled above or below the transverse axis 268 or imparted with a taper, obstruction, or other modification to alter the spray angle or spray pattern of the emitted fluid. It is also contemplated that any swirl chamber or insert known to one of skill in the art may be used with the present embodiments.

FIGS. 7 and 9 depict opposing first and second stopping members 274, 276, which extend interiorly from the inner surface 220 of the second actuating member 154. The first and second stopping members 274, 276 engage with portions of the sidewall 104 defining the rectangular opening 128. The first and second stopping members 274, 276 restrict the outward movement of the actuator 150 from the housing 102.

Figure 10:
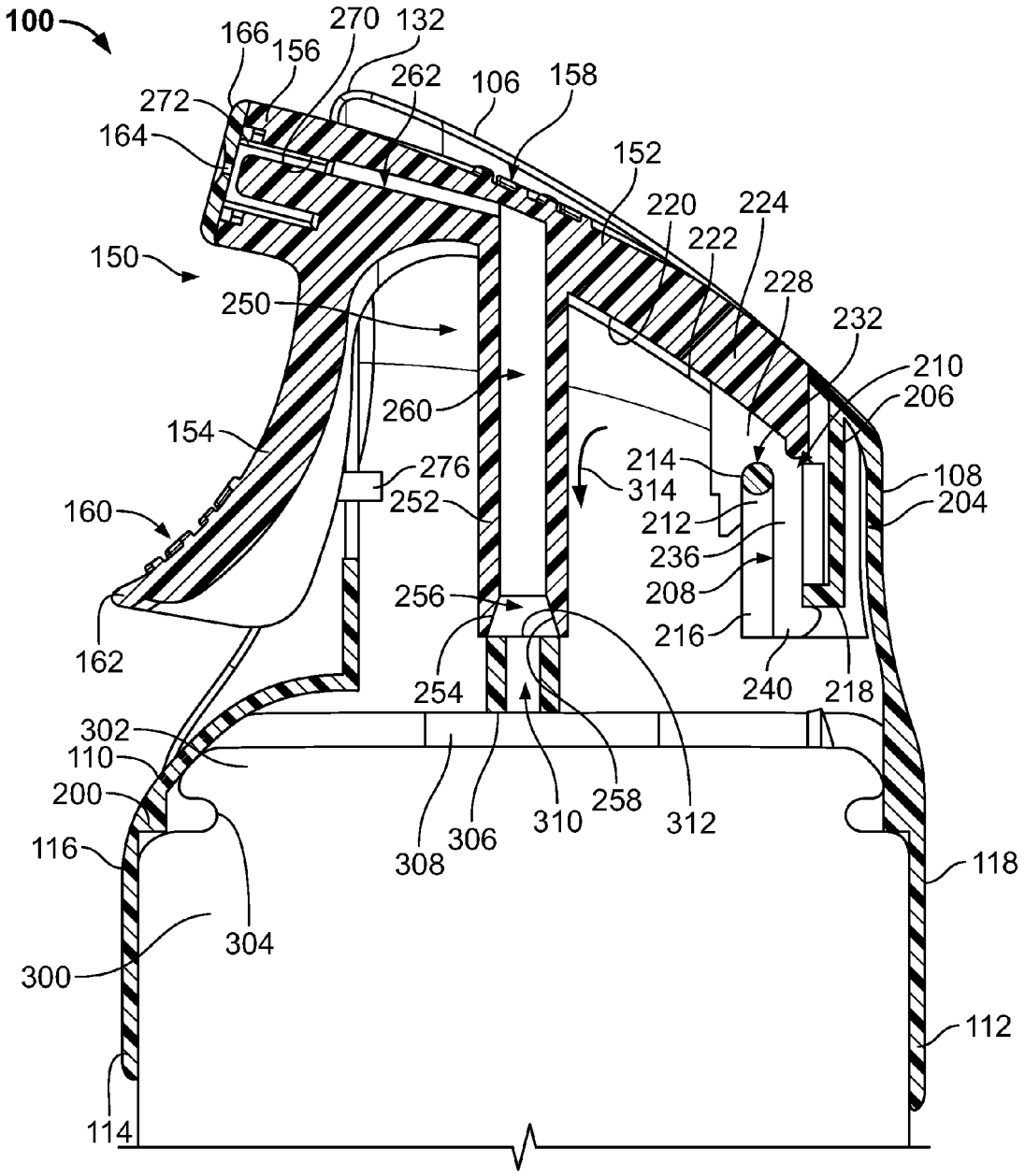
FIG. 10 illustrates a view similar to the one shown in FIG. 9 with the addition of a pressurized container during a non-use state of the dual activated actuator cap.

Turning to FIG. 10, the dual activated actuator cap 100 is shown in a non-use state with a pressurized container 300. In a preferred embodiment, the pressurized container is a conventional aerosol container. Alternatively, the pressurized container may comprise a non-pressurized receptacle in combination with an intermediate pressurization structure having a valve stem. Examples of such containers may be found in Capra et al. U.S. Pat. No. 4,174,052, Capra et al. U.S. Pat. No. 4,222,500, Hammett et al. U.S. Pat. No. 4,872,595, Hutcheson et al. U.S. Pat. No. 5,183,185, Tubaki et al. U.S. Pat. No. 5,240,153, Tubaki et al. U.S. Pat. No. 5,328,062, Tubaki et al. U.S. Pat. No. 5,392,959, Tubaki et al. U.S. Pat. No. 5,474,215, and Blake U.S. Pat. No. 6,708,852, which are herein incorporated by reference in their entirety. It is also contemplated that any type of hydrocarbon or non-hydrocarbon propellant may be used in connection with the pressurized containers noted above. One such non-hydrocarbon propellant may comprise a compressed gas selected from one or more of compressed air, nitrogen, nitrous oxide, inert gases, carbon dioxide, etc.

It is contemplated that a fluid, e.g., an air fragrancing composition, may be released from the above noted containers with any flow rate or with any spray droplet particle size. For example, it is preferable to have a spray release flow rate of from about 0.1 grams/second to about 1.8 grams/second. In one specific embodiment, a container is filled with at least 150 grams of an air fragrancing composition and placed under pressure by a compressed gas. Release of the air fragrancing composition over a 10 second period results in a spray release flow rate of about 1.5 grams/second. It is also preferable to have a spray droplet particle size in a range of about 10 microns to about 100 microns, and even more preferable to have a spray droplet particle size in a range of about 20 microns to about 70 microns.

For purposes of the presently described embodiment, the container 300 is an aerosol container, which includes a mounting cup 302 disposed within a neck 304 of the container 300. A valve assembly (not shown) is disposed within an upper portion of the container 300 and includes a valve stem 306 that extends through a pedestal 308 centered within the mounting cup 302. The valve stem 306 is a generally cylindrical tube having a passage 310 disposed longitudinally therethrough. A distal end 312 of the valve stem 306 extends upwardly away from the mounting cup 302 and a proximal end (not shown) is disposed within the valve assembly. Axial compression of the valve stem 306 opens the valve assembly, which allows a pressure difference between an interior of the container 300 and the atmosphere to force the contents of the container 300 out through the valve stem 306. Alternatively, the valve stem may be radially actuable.

The actuator 150 is maintained in the non-use state by a bias exerted by the hinging element 210 substantially about the pivot bar 214 of the mounting assembly 204. The bias in the present state causes the actuator 150 to move outward and away from the front side 116 and the top portion 106 of the housing 102. As previously noted, the stopping members 274, 276 prevent substantial outward displacement by engaging with portions of the sidewall 104. In the non-use state the valve stem 306 of the aerosol container 300 is disposed within the base 254 of the manifold 250. However, a sufficient amount of force to actuate the valve stem 304 is not provided. In one embodiment, the valve stem 306 is not sealingly engaged with the base 254 during the non-use state. In a different embodiment, the valve stem 306 is sealingly engaged with the base 254. Further, the valve stem 306 may be partially depressed during the non-use state to a degree insufficient to actuate same. In the embodiments where the valve stem 306 is engaged and/or partially depressed during the non-use state, the valve stem 306 may also exert an upward bias through the manifold 250 to maintain the actuator 150 in the present state.

Figure 11:
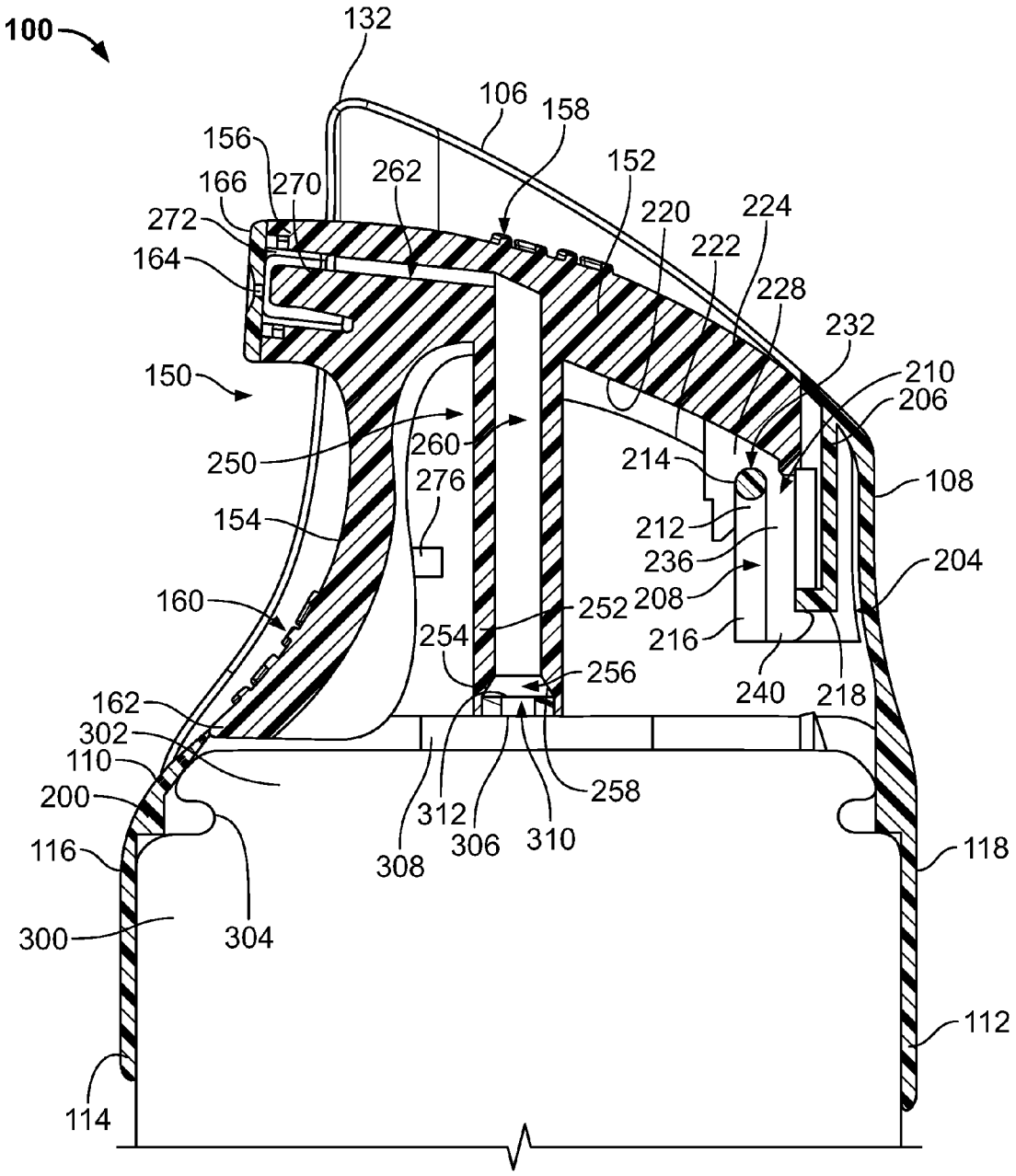
FIG. 11 illustrates a view similar to the one shown in FIG. 10 with the dual activated actuator cap in an in-use state.

Turning to FIG. 11, an in-use state is depicted that is representative of either the first actuating member 152 or the second actuating member 154 being engaged. To actuate the actuator cap 100 through the first actuating member 152 a user applies a substantially longitudinal force thereto, which is translated into a downward rotational force about the hinging element 210 in the direction of arrow 314. Similarly, when a user applies a substantially transverse force to the second actuating member 154, the transverse force is translated into a rotational force about the hinging element 210 in the direction of arrow 314. Sufficient downward rotational movement of the actuator 150 causes the base 254 of the manifold 250 to fully engage the valve stem 304 to open the valve assembly within the container 300. Fluid from an interior of the container 300 passes through the valve stem 306, past the cylindrical orifice 256 of the base 254, into the first and second channels 260, 262, through the swirl chamber 270 of the nozzle 156, and into the atmosphere.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. An actuator cap, comprising:

a housing configured to be attached to a container having a valve stem;

a dispensing orifice in fluid communication with a manifold, wherein the manifold includes a base adapted to place same in fluid communication with the valve stem of the container; and an actuator including first and second actuating members extending from an end defined by the dispensing orifice, the first actuating member further including a first actuating surface that includes a distal end and the second actuating member further including a second actuating surface that includes a lower end, the actuator hingedly attached to the housing at a pivot located within a region bounded in an actuated state by the dispensing orifice ends of the first and second actuating members and the distal end of the first actuating surface and the lower end of the second actuating surface such that the actuator resiliently deforms about the pivot when one of the first and second actuating members is actuated.

2. The actuator cap of claim 1, wherein the first actuating member is a push button and the second actuating member is a trigger.

3. The actuator cap of claim 1, wherein the dispensing orifice is disposed between the first and second actuating members.

4. The actuator cap of claim 1, wherein the housing is retained on the container having the valve stem and the base of the manifold is in fluid communication with the valve stem.

5. The actuator cap of claim 4, wherein actuation of one of the first and second actuating members causes the valve stem to be depressed and fluid from the container to be communicated through the manifold and out the dispensing orifice.

6. The actuator cap of claim 4, wherein the container is a pressurized container housing a volatilized fluid.

7. The actuator cap of claim 1, wherein the region defining the location of the pivot is further defined by the dispensing orifice ends of the first and second actuating members and a first axis located at the distal end of the first actuating surface and a second axis located at the lower end of the second actuating surface, wherein the first axis is parallel to a longitudinal axis of the housing and the second axis is parallel to a transverse axis of the housing.

* * * * *